US006846361B2

(12) United States Patent
Ketterer

(10) Patent No.: US 6,846,361 B2
(45) Date of Patent: Jan. 25, 2005

(54) MURAL DESIGN KIT AND METHOD

(75) Inventor: Robert F. Ketterer, St. Louis, MO (US)

(73) Assignee: Home Design Alternatives, Inc., Earth City, MO (US)

( * ) Notice: Subject to any disclaimer, the term of this patent is extended or adjusted under 35 U.S.C. 154(b) by 81 days.

(21) Appl. No.: 10/351,239

(22) Filed: Jan. 24, 2003

(65) Prior Publication Data

US 2003/0141012 A1 Jul. 31, 2003

Related U.S. Application Data

(60) Provisional application No. 60/351,852, filed on Jan. 25, 2002.

(51) Int. Cl.[7] ..... B05C 17/12
(52) U.S. Cl. ..... 118/76; 434/84
(58) Field of Search ..... 118/76, 504; 434/84

(56) References Cited

U.S. PATENT DOCUMENTS 3,589,507 A 6/1971 Greenberg et al.
4,328,051 A 5/1982 Robinette
4,696,400 A 9/1987 Warman
5,460,087 A * 10/1995 Ogorzalek ..... 101/128.21
6,045,639 A 4/2000 Davis
6,217,336 B1 4/2001 Matthews
6,343,934 B1 2/2002 Johnson, Jr.

* cited by examiner

*Primary Examiner*—Laura Edwards
(74) *Attorney, Agent, or Firm*—Senniger Powers

(57) ABSTRACT

A wall mural painting kit for painting a mural on a wall or other flat surface. The kit has multiple pattern transfer sheets. Each pattern transfer sheet has first and second opposite faces. A layer of transfer material is on the first face and a pattern of a mural is on the second face. One or more alignment markings is provided on the second face for use in placing said sheet in correct position on said wall or other flat surface. The kit may include a supply of adhesive tape having a non-aggressive adhesive. The tape is marked at regular intervals along the length of the tape so that the tape may be torn or cut from said supply in appropriately-sized segments to allow each pattern transfer sheet to be affixed to a wall or other flat surface with a desired number of said segments.

12 Claims, 5 Drawing Sheets

MURAL DESIGN KIT AND METHOD

CROSS-REFERENCE TO RELATED APPLICATION

This application claims the benefit of U.S. provisional application Ser. No. 60/351,852 filed Jan. 25, 2002, the entire disclosure of which is incorporated herein by reference.

BACKGROUND OF THE INVENTION

This invention relates generally to crafts and home decor, and more particularly to painting murals on walls or other flat surfaces.

Many consumers, and particularly parents of young children, enjoy decorating the walls of their homes with wallpaper, border, and other materials, all exhibiting a "theme" such as zoo animals, balloons, or sports-related themes. This invention is directed primarily to consumers for use in decorating the walls of their homes, but the invention could also be used to decorate any large, flat surface, such as a bulletin board, chalkboard, or sheet of canvas. In addition, the invention can be used on the walls of businesses, studios, and retail establishments, as well as in private homes.

A number of products are available to facilitate painting wall murals by various methods. For example, U.S. Pat. No. 6,045,639 issued to Davis on Apr. 4, 2000 discloses a kit and method for creating wall murals. Davis discloses positioning a transfer sheet on a surface to be painted. The transfer sheet has a graphic design outlined on a front side and a transfer medium applied to a back side which is placed adjacent the surface to be painted. Selected elements of the design are transferred from the transfer sheet to the surface by rubbing the outline of the graphic design with a tracing instrument. The transfer sheet is then removed and the mural is painted using the traced outline as a guide. The Davis kit and method are designed to enable the transfer sheet to be reapplied in exactly the same position on the surface after the paint has dried, thereby allowing several iterations of the process to paint successively more detailed design elements on top of previously painted design elements. To facilitate repositioning of the transfer sheet on the wall, an alignment guide comprising a horizontal strip of material with vertical alignment markings is taped to the wall. The upper edge of the transfer sheet has an alignment scale with corresponding vertical alignment markings. The transfer sheet is taped to the wall using the alignment scale to align the transfer sheet with the alignment guide. After the tracing is complete, the transfer sheet is removed from the wall to enable painting, but the alignment guide is left on the wall so the transfer sheet can later be repositioned under the alignment guide for more detailed work on the mural.

Similarly, U.S. Pat. No. 6,343,934 issued to Johnson on Feb. 5, 2002 discloses a kit and method for creating a wall mural. Johnson discloses using a unified pattern sheet of paper with an outline drawing on the front side and a backing of transfer material, preferably carbon, on the back side. The unified sheet is positioned on a surface to be painted with the back side adjacent the surface. A pencil or other instrument is rubbed against the outline of the mural to transfer the outline to the surface. The pattern sheet is then removed and the outlined areas filled with paint. The Johnson kit and method further contemplate providing instructions for mixing many colors of paint for the mural out of a few basic colors and tint bases, thereby reducing the number of kinds of paint required to complete a mural having many colors.

U.S. Pat. No. 6,217,336 issued to Matthews on Apr. 17, 2001 discloses still another kit and method for creating wall murals. Matthews discloses placing a pattern sheet coated with a transferable material against a surface to be painted, transferring the pattern to the surface to be painted by applying energy such as by rubbing or heating the pattern sheet, removing the pattern sheet, and then painting in the areas outlined by the pattern. The Matthews kit and method further contemplate pattern sheets with interchangeable design elements, so that a female figure in the main pattern may be cut out and replaced with a similar male figure, for example. Furthermore, Matthews discloses that large patterns may be contained on multiple smaller pattern sheets rather than one large pattern sheet. When using a number of pattern sheets to transfer a large design to a wall, it is necessary to align each of the pattern sheets with the adjacent pattern sheets before transferring the pattern to the wall.

While the foregoing kits and methods can be helpful in the painting of a wall mural, it has been found that it is difficult to obtain proper alignment of pattern transfer sheets when multiple sheets are used to paint a large mural. It is best to avoid relying on the edges of the pattern transfer sheets for alignment because the sheets may not have square edges. Furthermore, many automated printing processes do not allow the printing to extend all the way to the edge of the pattern transfer sheet, thereby necessitating a print-free margin on at least some edges of the sheets. This requires the print-free margins to be cut from the pattern transfer sheets, sometimes by the consumer, which makes use of the resulting edge for alignment even more unreliable. Furthermore, there is a possibility that the design printed on a pattern transfer sheet may not be precisely aligned with the edges of the sheet. Thus, it would be desirable for pattern transfer sheets in a wall mural kit to have alignment features that do not rely on edge-based alignment.

The initial placement of the first pattern transfer sheet in a multi-sheet mural kit is important because any error in orientation of this first sheet will be magnified when the remaining pattern transfer sheets are aligned with the first sheet. Thus, the improper orientation of the overall mural caused by the misalignment of the initial pattern transfer sheet can be readily apparent even though the error may not have been noticeable with only one sheet on the wall. It is possible to obtain good alignment of the initial sheet by conventional methods. In general, however, conventional methods of alignment are time consuming and involve making multiple measurements with one hand while the pattern sheet is held in place on the wall with the other. This increases the chance of erroneous alignment. The conventional methods also tend to rely on edge-based alignment. For example, one such method involves placing a carpenter's level or similar device against an edge or top of the pattern transfer sheet to align the edge vertically or horizontally. This method is difficult to use because a person has to simultaneously hold the level, position the pattern transfer sheet, and tape or otherwise fasten the sheet to the wall. The complexity of the required maneuvers can lead to alignment errors. Furthermore, aligning an edge or top of the pattern transfer sheet with a level invites all the problems associated with edge-based alignment.

After alignment of the initial pattern transfer sheet, the remaining pattern sheets must be aligned with the initial sheet. Typically, this is done by lining up the edges of the sheets, but this also invites the problems associated with edge-based alignment. When elements of the design overlap adjacent pattern transfer sheets, one can avoid edge-based alignment by matching the design elements to the corresponding design element on the adjacent sheet. However, this only possible where design elements overlap the edges of the pattern transfer sheets. Furthermore, it is time consuming and requires effort in making sure the matched design elements truly correspond to each other, a task that can be difficult when a detailed mural is being painted. Also, a design element may be curved or have a limited linear extent, thereby limiting the length of the design element that is useful in aligning the pattern sheets. When the design element offers only a short length for alignment, the pattern transfer sheets may appear to be in alignment when they are actually slightly out of alignment. Another complication in alignment is that small errors in alignment are difficult to detect from the vantage point up close as the pattern transfer sheet is being placed on the wall, but the small errors become much more noticeable standing back after all the sheets are in place. Because of the difficulties involved, alignment of multiple pattern transfer sheets by matching corresponding design elements that overlap adjacent sheets is too unreliable for use in a large mural.

Another difficulty encountered in aligning pattern transfer sheets for transferring a mural pattern to a wall is that specially-adapted adhesive tape with a relatively non-aggressive adhesive, sometimes referred to as painter's tape, is often required to tape the sheets to the wall to avoid damage to any pre-existing paint that may be on the wall. Thus, wall mural kits often include a roll of painter's tape for this purpose. In general, however, manufacturers prefer to keep costs down by including no more tape than necessary to complete the mural. The task of holding an aligned pattern transfer sheet in position while simultaneously tearing pieces of tape off the roll for taping the sheets to the wall is a difficult task for one person. Nonetheless, people may be reluctant to tear off the necessary pieces of tape in advance knowing that there is a limited supply of tape, fearing that they will run out of tape if they use too much tape on the first sheet. Instead, they may prefer to wait to tear off the tape segments until needed so they can make adjustments in the length of the tape if necessary. More reliable alignment would be obtained if there was a way to encourage the user to prepare the tape segments prior to positioning pattern sheets on the wall. From a manufacturer's cost standpoint, it would be preferable if this could be accomplished without providing kits with an unnecessary surplus of tape.

The kit and method described in the Davis patent provide some alignment features in the alignment guide strip and the alignment scale along the top edge of the pattern transfer sheet. However, the alignment scale and alignment guide merely allow the sheet to be repositioned exactly in the original position, whether that position was aligned or not. Davis does not provide any assistance in initial alignment of the pattern transfer sheet. For this Davis relies on the carpenter's level to horizontally align the alignment guide. The alignment features in Davis also rely on edge-based alignment, which poses the potential problems discussed above. Moreover, the Davis alignment features could not be extended to mural kits with multiple rows of pattern transfer sheets because the alignment guide would interfere with placement of an adjoining sheets in abutting relation with the top edge of the initial pattern sheet. Thus, the Davis alignment features suffer significant drawbacks.

Accordingly, there is a need for a wall mural painting kit that has an improved alignment features to avoid the aforementioned problems.

SUMMARY OF THE INVENTION

In general, this invention is directed to a wall mural painting kit for painting a mural design on walls or other flat surfaces. The kit comprises multiple generally rectangular pattern transfer sheets. Each pattern transfer sheet has first and second opposite faces. A layer of transfer material is on the first face and a portion of a mural pattern is on the second face. One or more alignment markings is printed on the second face of each pattern transfer sheet for use in placing said sheet in correct alignment on the wall or other flat surface. The kit may also comprise a supply of adhesive tape having a non-aggressive adhesive. The supply of tape is marked at regular intervals along the length of the tape. The markings on the tape are spaced apart from each other a distance so that the tape may be torn or cut from the supply in appropriately-sized segments to allow each pattern transfer sheet to be affixed to a wall or other flat surface with a desired number of such segments.

To use the wall mural painting kit of the present invention, a person tapes the pattern transfer sheets with their first faces against a wall or other flat surface to be painted in alignment with each other by matching up alignment markings provided on the pattern transfer sheets. Then the person traces the mural pattern with a tracing instrument thereby transferring the mural pattern to the wall or other flat surface. Next, the person removes the pattern transfer sheets from the wall or other flat surface. Finally, the person paints the wall mural on the wall or other flat surface, using the traced pattern as a guide.

BRIEF DESCRIPTION OF THE DRAWINGS

Corresponding reference characters indicate corresponding parts throughout the drawings.

DETAILED DESCRIPTION OF PREFERRED EMBODIMENTS

Kits of the present invention may be designed to paint a mural of any desired size. By way of example only, a three-sheet kit 1 will be discussed in detail to illustrate the alignment features of the kit and to explain how the method of the present invention can be used to paint a wall mural. Then a larger nine-sheet kit 101 will be discussed as an example of how the alignment features and method of painting a mural can be expanded to larger murals.

Figure 1:
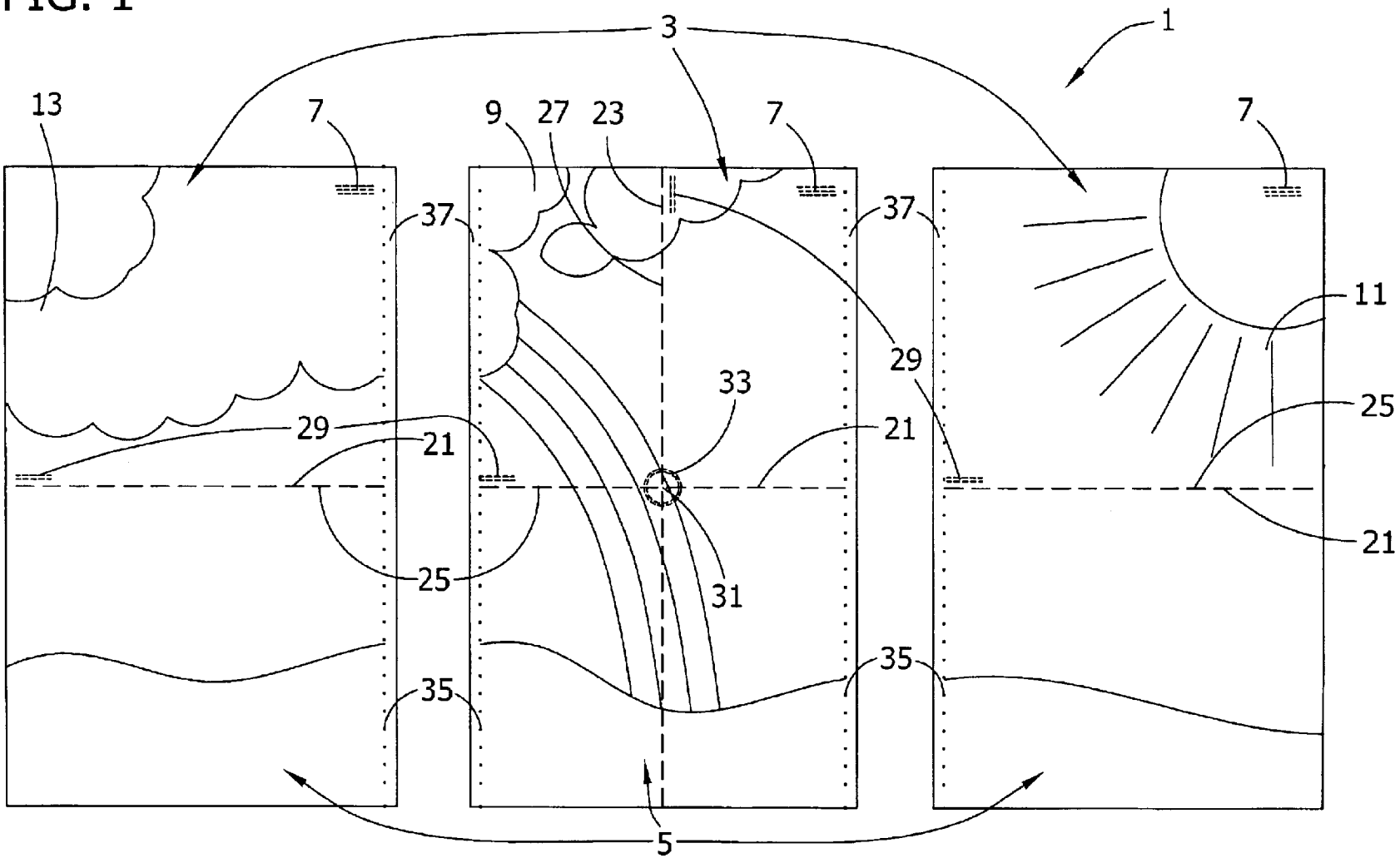
FIG. 1 is a diagram of the pattern transfer sheets of a three-sheet wall mural kit of the present invention with the pattern transfer sheets arranged in the order they would be positioned on a wall or other flat surface.
Figure 6:
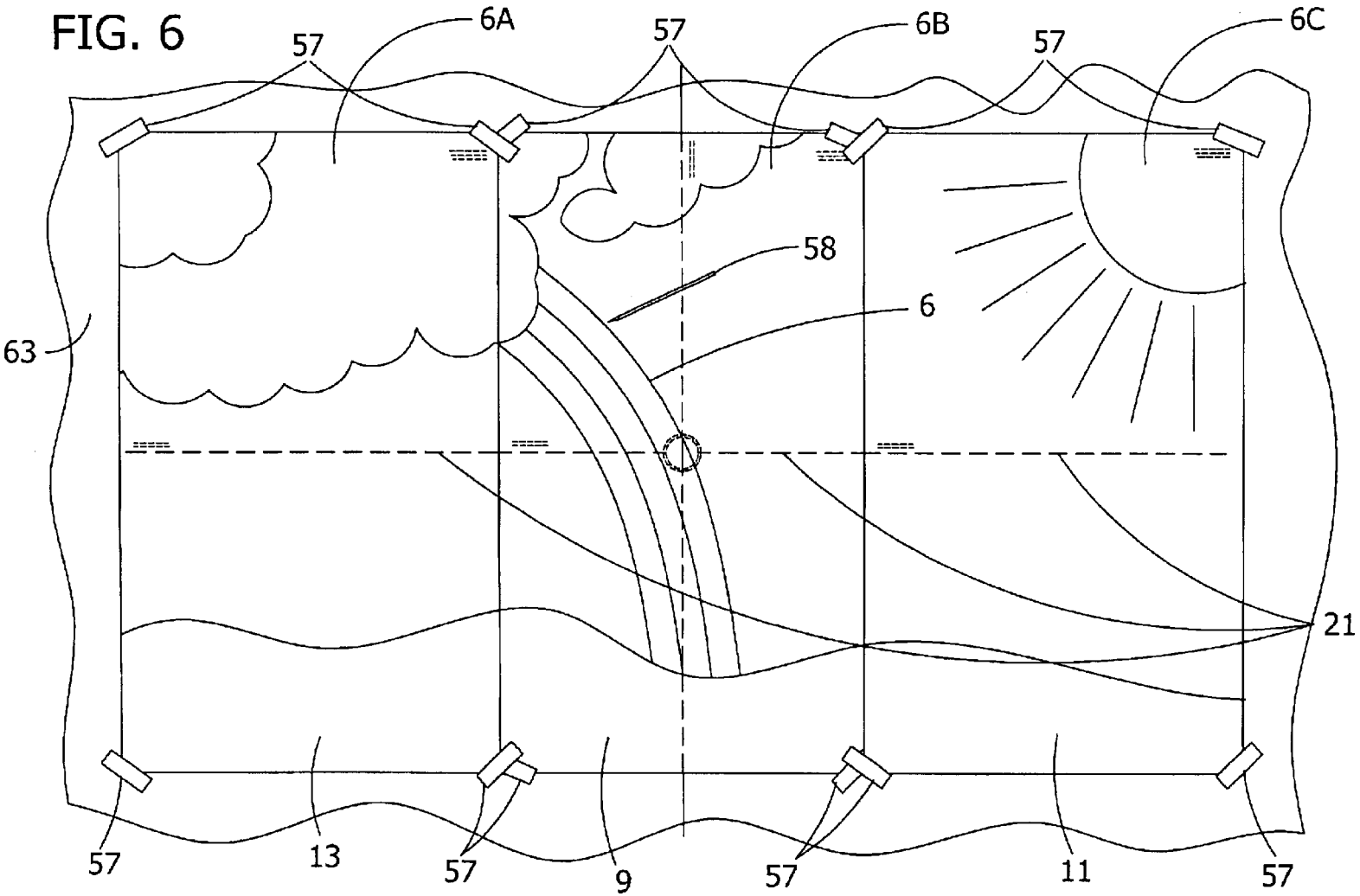
FIG. 6 is a diagram of the two side pattern transfer sheets of the wall mural kit of FIG. 1 taped on the wall adjacent the center pattern transfer sheet with horizontal alignment markings on the side pattern transfer sheets aligned with a horizontal marking on the center pattern transfer sheet.

FIG. 1 shows the pattern transfer sheets 3 of a three-sheet kit 1 of the present invention. In FIG. 1 the three pattern transfer sheets 3 are designed to be arranged in a horizontal row, although other arrangements could also have been used depending on the size and shape of the mural to be painted. For the kit 1 of FIG. 1, which represents only one exemplary embodiment, the pattern transfer sheets 3 are each about three feet wide and five feet long. The pattern transfer sheets 3 may be constructed of any thin flexible material. Preferably, the pattern transfer sheets 3 are constructed of paper. Each pattern transfer sheet 3 has a first face (not shown) with a backing of a transfer material thereon. A particularly preferred transfer material is carbon. Each pattern transfer sheet also has a second face 5 which has a portion of a mural pattern 6 printed or otherwise provided thereon. As shown in FIG. 6, for example, the mural pattern 6 for the three-sheet kit 1 is divided into three portions 6A, 6B, 6C with each pattern transfer sheet 3 having only one such portion so the entire mural pattern 6 is visible when the pattern transfer sheets 3 are placed adjacent each other. The illustrations show one exemplary mural pattern 6, but the pattern transfer sheets may be constructed with any mural pattern that may be desired. In one embodiment, the outline of the desired mural is printed on the pattern transfer sheets 3 by a commercial-scale printing process. However, the outline could be printed or drawn on the pattern transfer sheets 3 by any method, including by hand, without departing from the scope of this invention.

Figure 2:
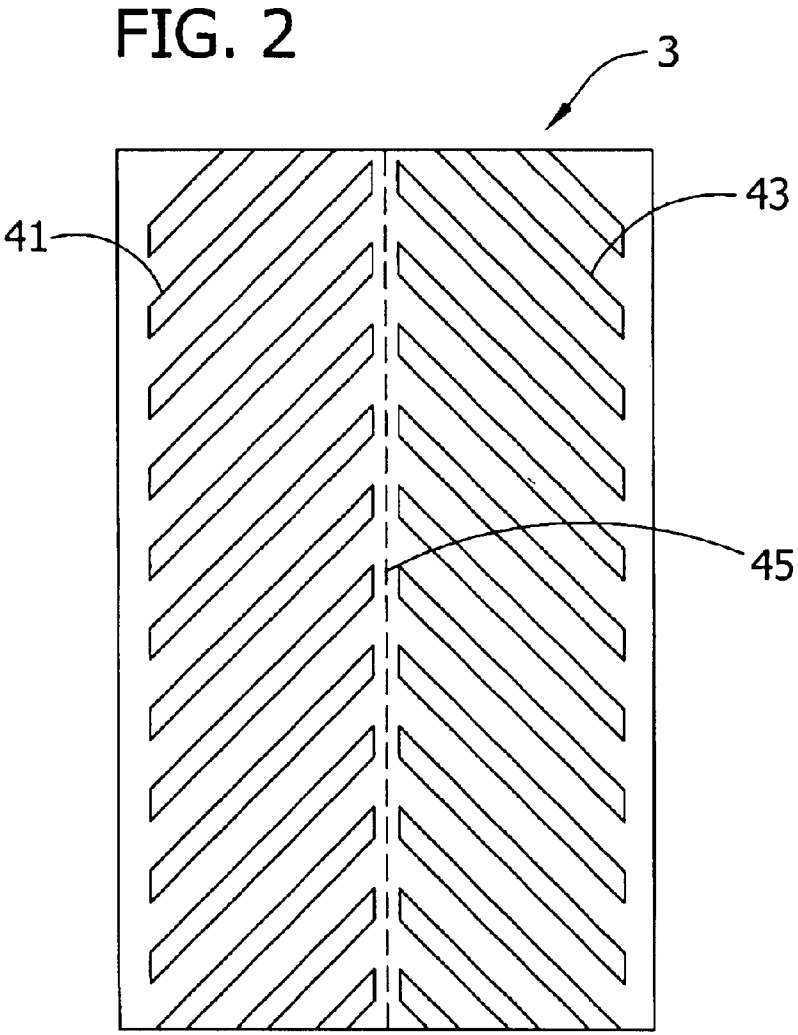
FIG. 2 is a diagram of a pattern transfer sheet of a wall mural kit of the present invention showing the watermark stripes forming upward pointing arrow-shaped markings.

A number of alignment markings are provided to help the user ascertain the general position and orientation of each pattern transfer sheet 3 relative to the other pattern transfer sheets 3. In one embodiment of this invention (FIG. 2) each pattern transfer sheet 3 has two sets of parallel diagonal watermark stripes 41, 43. The stripes in the first set 41 ascend at a forty-five degree diagonal from one side of the respective pattern transfer sheet 3 and terminate near the vertical centerline 45 of the respective pattern transfer sheet 3. The stripes in the second set 43 ascend at a forty-five degree diagonal from the other side of the respective pattern transfer sheet 3 and also terminate near the vertical centerline 45 of the respective pattern transfer sheet 3. The stripes in the second set 43 are vertically aligned with the stripes in the first set 41. The overall effect is a series of large upward-pointing arrow shapes forming the background of the pattern transfer sheets 3. Those skilled in the art will understand that other designs could be used for orientation of the pattern transfer sheets 3 as well.

As shown in FIG. 1, the three pattern transfer sheets 3 of the three-sheet kit 1 are appropriately labeled with wording or other indicia 7 on their respective second faces 5, one sheet 3 being labeled as the center sheet 9, another as the right-side sheet 11, and the third as the left-side sheet 13. In another embodiment, the center point 31 of the mural pattern 6 may be marked by a band of wording 33 on the center pattern transfer sheet 9 stating "center point of mural," for example, encircling the center point 31 of the mural pattern 6. Also, in one embodiment linear boundary markings 35 on the pattern transfer sheets 3 mark the boundaries between the mural pattern 6 and the beginning of the print-free margins 37 required by a particular printing process that may be used to manufacture the pattern transfer sheets 3.

A number of other alignment markings are also provided on the second faces 5 of the pattern transfer sheets 3 to help obtain proper alignment of the pattern transfer sheets on the wall or other flat surface. First, each pattern transfer sheet 3 has a horizontal linear alignment marking 21 extending along the horizontal centerline 25 of the mural pattern 6. The center sheet 9 also has a vertical linear alignment marking 23 extending along the vertical centerline 27 of the mural pattern 6. In one embodiment, the horizontal and vertical centerlines 25, 27 of the mural pattern 6 are labeled as such with wording or other indicia 29 on the pattern transfer sheets 3. The horizontal and vertical linear alignment markings 21, 23 for the kit 1 shown in FIG. 1 happen to coincide with the centerlines 25, 27 of the entire mural pattern 6, but as will be shown later this is not necessarily the case. If a different configuration of pattern transfer sheets 3 is used, additional linear alignment markings may be provided along one or more centerlines of the particular portions of the mural pattern 6A, 6B, 6C. In the kit 1 of FIG. 1, however, providing vertical alignment markings along a vertical centerline of the portions of the mural pattern 6A, 6C printed on the side pattern transfer sheets 11, 13, for example, would serve no purpose because none of the pattern transfer sheets 3 are to be aligned adjacent the upper or lower edges of the two side pattern transfer sheets 11, 13. The linear alignment markings 21, 23 may be constructed differently from the linear boundary markings 35 to enable the user to readily differentiate between the two types of linear markings. As shown in FIG. 1, for one example, the linear alignment markings 21, 23 may be dashed lines and the linear boundary markings 35 maybe dotted lines. Although the illustrated embodiments contain only horizontal and vertical linear alignment markings 21, 23, those skilled in the art will appreciate from this disclosure that advantages of the present invention may be obtained by providing diagonal linear alignment markings on the pattern transfer sheets 3 without departing from the scope of this invention.

Figure 3:
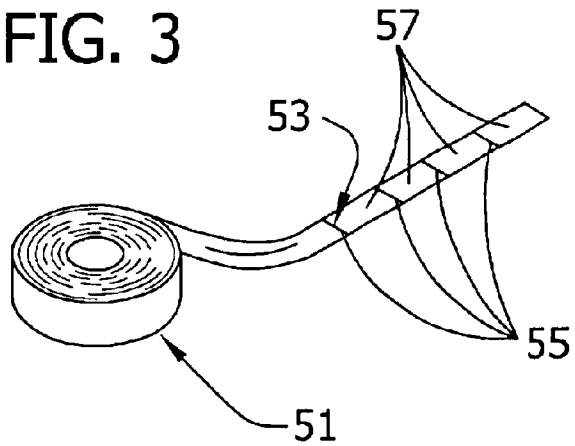
FIG. 3 is a diagram of a supply of tape that may be provided in a kit of the present invention showing markings at regular intervals along the length of the tape.

The kit 1 may include a supply (e.g., roll) of adhesive tape 51, a length 53 of which is shown in FIG. 3. The adhesive used on the tape 51 is purposely relatively non-aggressive so that the tape 51 can be removed from the wall without damaging any paint that may already be on the wall. As shown in FIG. 3, the tape has marks 55 along its length 53 at regular intervals (e.g., every three inches) to define tape segments 57 of a convenient length. The supply of tape 51 contains enough tape to provide a sufficient number of tape segments 57 to tape all the pattern transfer sheets 3 on a wall or other flat surface. The kit may also include a tracing instrument 58 (FIG. 6) to use in transferring the mural pattern to the wall or other flat surface. Although not shown in the drawings, the kit 1 may also include instructions for the user, a paint brush, a paint-by-number color guide, a blank outline model of the mural pattern to help a person devise his or her own color scheme, paint, and/or a paint pen to create sharp outlines for design elements of the mural after the paint has dried.

Figure 5:
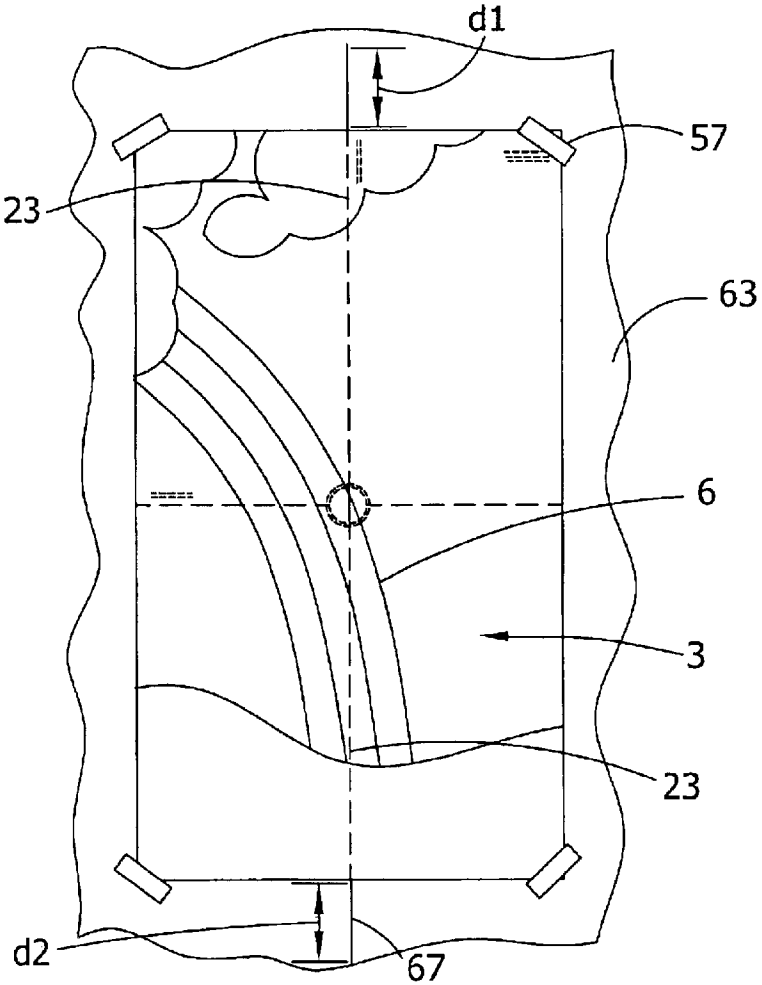
FIG. 5 is a diagram of the center pattern transfer sheet of the wall mural kit of FIG. 1 taped on the wall in alignment with the vertical line segment of FIG. 4.
Figure 4:
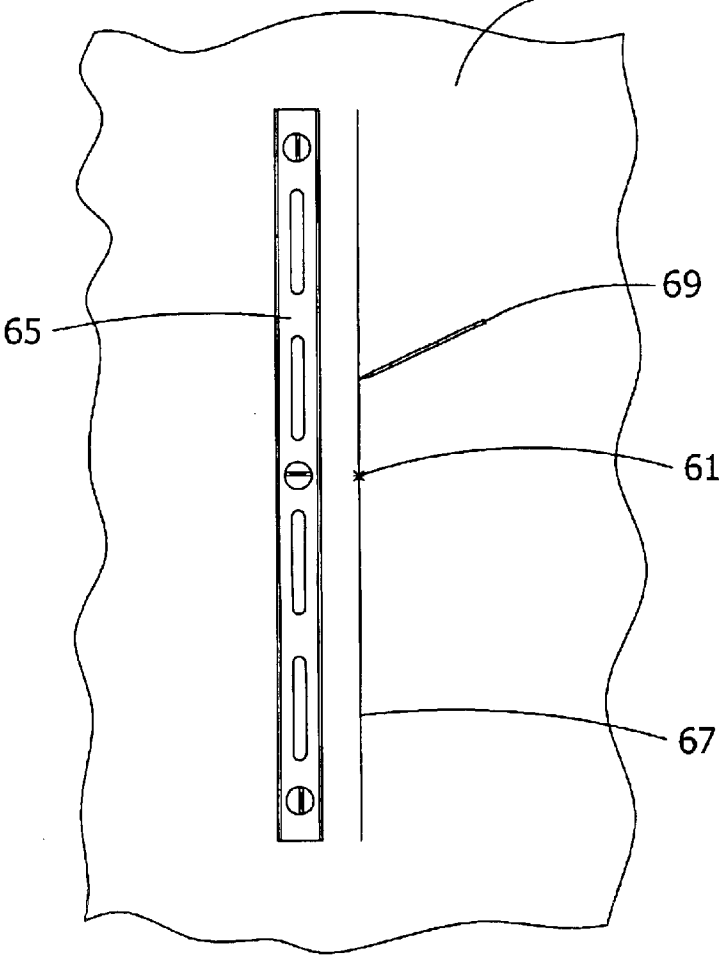
FIG. 4 is a diagram of a vertical line segment drawn through a center mark located at the point on a wall where the mural is desired to be centered.

To use the wall mural painting kit 1, one cuts along the linear boundary lines 35 to remove the print-free margins 37 from the pattern transfer sheets 3 to allow the portions of the mural pattern 6A, 6B, 6C on the pattern transfer sheets 3 to be placed immediately adjacent each other. As shown in FIG. 4, a small center mark 61 (e.g., an "x") is placed on a wall 63 at a location where the mural is to be centered. A level or other device 65 and writing instrument 69 are then used to draw a vertical line segment 67 through the mark 61. Care must be taken to construct the vertical line segment 67 so that the mark 61 is at the midpoint of the vertical line segment 67 and so the vertical line segment 67 is longer than an overall dimension of at least one pattern transfer sheet 3. For example, in the case of the kit 1 of FIG. 1 wherein the center pattern transfer sheet 9 is five feet in length, the vertical line segment 67 may extend two feet, seven inches above and below the center mark 61, making the total length of the vertical line segment five feet, two inches. The center pattern transfer sheet 9 is identified and taped to the wall 63 as shown in FIG. 5 so the vertical line segment 67 is aligned with the vertical linear alignment marking 23 on the center pattern transfer sheet 9. The proper height is obtained by positioning the center pattern transfer sheet 9 so that the distance d1 the vertical line segment 67 extends above the center pattern transfer sheet 9 equals the distance d2 the vertical line segment 67 extends below the center pattern transfer sheet 9. As shown in FIG. 6, the tape segments 57 may be used to tape the two side pattern transfer sheets 11, 13 adjacent to the center pattern transfer sheet 9 with the horizontal linear alignment markings 21 on the side pattern transfer sheets 11, 13 aligned with the horizontal linear alignment marking 21 on the center pattern transfer sheet 9. During the course of aligning and taping the pattern transfer sheets 3 to the wall 63 or other flat surface, a person may, and preferably will, use the markings 55 along the length of the tape 53 to tear or cut off at least enough tape segments 57 to tape the next pattern transfer sheet 3 to the wall 63 before the person tries to align that pattern transfer sheet 3. This will eliminate the need for the person to coordinate holding the pattern transfer sheet 3 in alignment while simultaneously tearing or cutting tape segments 57 from the supply of tape 51.

After the pattern transfer sheets 3 have been properly aligned and taped on the wall or other flat surface to be painted, the pattern 6 is traced with a tracing instrument 58 (FIG. 6) thereby causing the transfer material to rub off onto the wall 63 or other flat surface. The pattern transfer sheets 3 are then removed. The transferred pattern serves as a guide in painting the mural. Typically, one fills in the areas outlined by the pattern with different colors of paint, often according to a paint-by-number color scheme.

Figure 7:
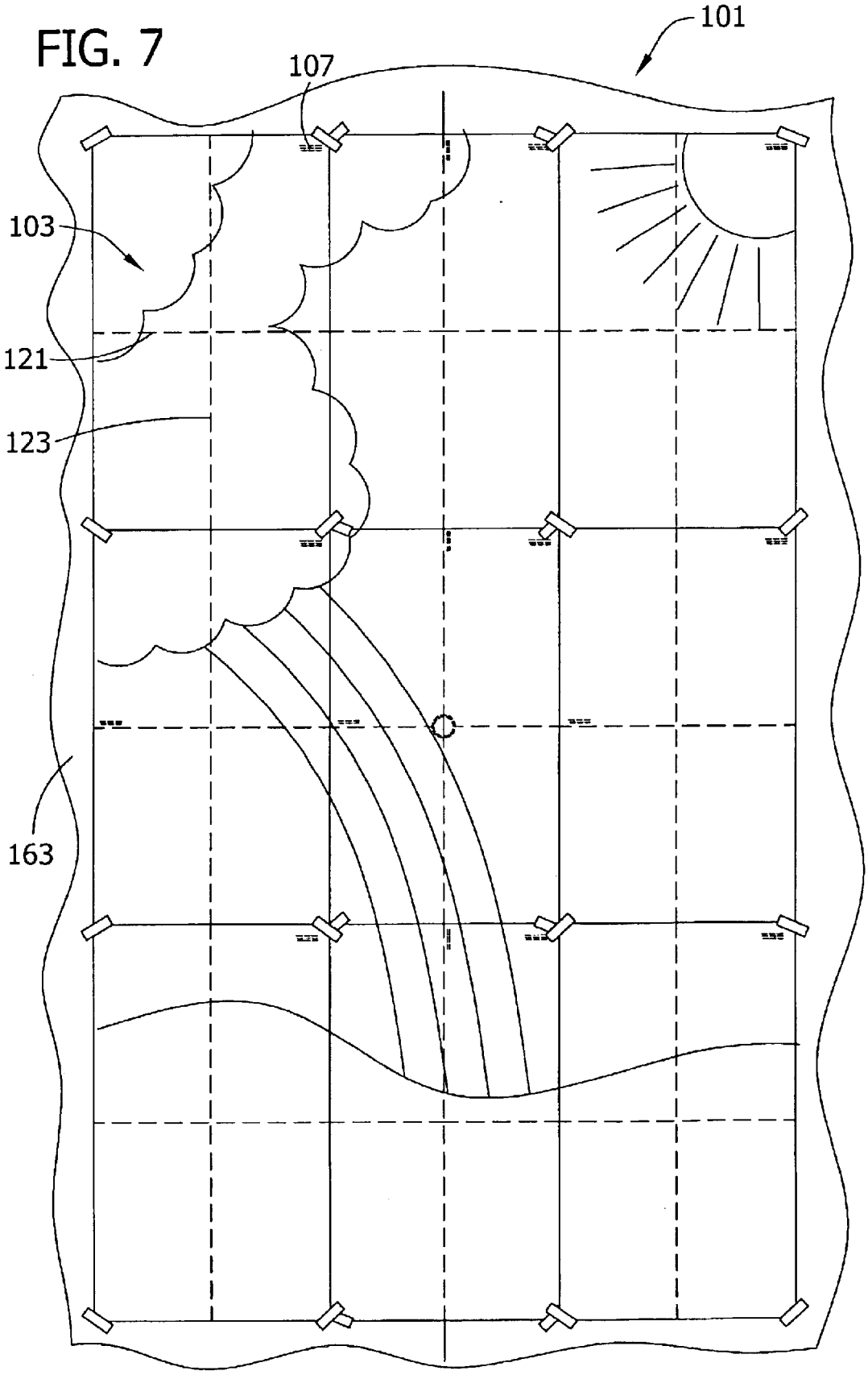
FIG. 7 is a diagram showing the alignment features of the present invention used in a wall mural kit having nine pattern transfer sheets.

As shown in FIG. 7, in another embodiment of the present invention a larger mural can be painted using a kit 101 having nine pattern transfer sheets 103 instead of three. The features of the invention that are unique to the nine-sheet kit 101 can be shown by reference to just one pattern transfer sheet 103 shown in aligned position relative to the other pattern transfer sheets 103. Each pattern transfer sheet 103 is labeled with wording or other indicia 107 to indicate the proper position of the pattern transfer sheet 103 in relation to the other pattern transfer sheets 103. For example, pattern transfer sheets 103 could be designated "upper row left corner," "upper row center," etc. Alternatively, the pattern transfer sheets 103 could be assigned a number corresponding to a position relative to the other pattern transfer sheets 103. As shown in FIG. 7, the nine pattern transfer sheets 103 have already had the print-free margins (not shown) removed and been taped to the wall 163 in a three-by-three formation or matrix. Each pattern transfer sheet 103 has linear alignment markings 121, 123 along both the horizontal and vertical centerlines of the particular portion of the mural pattern printed on the respective pattern transfer sheet 103. In contrast to the kit 1 of FIG. 1, all of the pattern transfer sheets are provided with both horizontal and vertical linear alignment markings 121, 123 because every pattern transfer sheet 103 is both horizontally and vertically adjacent to at least one other pattern transfer sheet 103. In all other respects, the nine-sheet wall mural kit 101 of FIG. 7 operates substantially the same as the three-sheet wall mural kit 1 of FIG. 1. Furthermore, it will be clear from the preceding example that kits of the present invention may be constructed with pattern transfer sheets designed to be aligned in any number of rows and columns.

When introducing elements of the present invention or the preferred embodiment thereof, the articles "a," "an," "the," and "said" are intended to be inclusive and mean that there are one or more of the elements. The terms "comprising," "including" and "having" are intended to be inclusive and mean that there may be additional elements other than the listed elements.

As various changes could be made in the above constructions and methods without departing from the scope of the invention, it is intended that all matter contained in the above description and shown in the accompanying drawings be interpreted as illustrative and not in a limiting sense.

What is claimed is:

1. A wall mural painting kit for painting a mural on a wall or other flat surface, said kit comprising multiple generally rectangular pattern transfer sheets, each pattern transfer sheet comprising first and second opposite faces, a layer of transfer material on said first face, a portion of a mural pattern on said second face, and one or more alignment markings on the second face of each pattern transfer sheet for use in placing said sheet in correct alignment on said wall or other flat surface, said alignment markings comprising an alignment marking on a first pattern transfer sheet that aligns with an alignment marking on second pattern transfer sheet when said first and second pattern transfer sheets are positioned adjacent each other in correct alignment on said wall or other flat surface.

2. A wall mural painting kit for painting a mural on a wall or other flat surface, said kit comprising multiple generally rectangular pattern transfer sheets, each pattern transfer sheet comprising first and second opposite faces, a layer of transfer material on said first face, a portion of a mural pattern on said second face, and one or more alignment markings on the second face of each pattern transfer sheet for use in placing said sheet in correct alignment on said wall or other flat surface, wherein said one or more alignment markings comprise an arrow-shaped marking that indicates proper upward orientation of the respective pattern transfer sheet.

3. A kit as set forth in claim 2 wherein the arrow-shaped marking is a watermark.

4. A kit as set forth in claim 1 wherein said one or more alignment markings includes a linear alignment marking on each pattern transfer sheet extending linearly from one edge of said portion of said mural pattern to another edge of said portion of said mural pattern.

5. A kit as set forth in claim 4 wherein said linear alignment marking on at least one pattern transfer sheet coincides with a centerline of the mural pattern.

6. A kit as set forth in claim 4 wherein said linear alignment marking coincides with a centerline of said portion of said mural pattern.

7. A kit as set forth in claim 4 wherein said linear alignment marking for a first pattern transfer sheet is co-linear with said alignment marking for a second pattern transfer sheet when said first and second pattern transfer sheets are positioned in correct alignment on said wall or other flat surface.

8. A kit as set forth in claim 7 wherein said linear alignment marking coincides with a centerline of the respective portion of said mural pattern for each of said first and second pattern transfer sheets.

9. A kit as set forth in claim 4 wherein said linear alignment marking for each pattern transfer sheet is co-linear with said linear alignment marking for at least one other pattern transfer sheet when the pattern transfer sheets are positioned in correct alignment on said wall or other flat surface.

10. A kit as set forth in claim 9 wherein said one or more alignment markings further comprise an arrow-shaped marking that indicates proper upward orientation of the respective pattern transfer sheet, a band of wording encircling a center point of said mural pattern, indicia on each pattern transfer sheet indicating the position of the respective sheet relative to the other pattern transfer sheets, and linear boundary markings separating print-free margins of the pattern transfer sheets from said mural pattern.

11. A wall mural painting kit for painting a mural on a wall or other flat surface, said kit comprising:

multiple generally rectangular pattern transfer sheets, each pattern transfer sheet comprising first and second opposite faces;

a layer of transfer material on said first face;

a portion of a mural pattern on said second face;

a supply of adhesive tape having a non-aggressive adhesive, said tape having markings thereon at regular intervals along the length of the tape, said markings being spaced apart from each other a distance so that the markings may used to tear or cut appropriately-sized tape segments from the supply to allow each pattern transfer sheet to be affixed to a wall or other flat surface with a desired number of said tape segments.

12. A kit as set forth in claim 11 wherein each pattern transfer sheet has one or more alignment markings on said second face comprising a linear alignment marking extending from one edge of said portion of the mural pattern to another edge of said portion of the mural pattern, and wherein said linear alignment marking on a first pattern transfer sheet is co-linear with said linear alignment marking on a second pattern transfer sheet when said first and second pattern transfer sheets are positioned in correct alignment on said wall or other flat surface.

* * * * *